US009931529B2

(12) United States Patent
Orenstein

(10) Patent No.: US 9,931,529 B2
(45) Date of Patent: Apr. 3, 2018

(54) PUSH UP DEVICE

(71) Applicant: The Prophet Corporation, Owatonna, MN (US)

(72) Inventor: Amber Orenstein, Prior Lake, MN (US)

(73) Assignee: THE PROPHET CORPORATION, Owatonna, MN (US)

( * ) Notice: Subject to any disclaimer, the term of this patent is extended or adjusted under 35 U.S.C. 154(b) by 0 days.

(21) Appl. No.: 14/679,558

(22) Filed: Apr. 6, 2015

(65) Prior Publication Data

US 2016/0051853 A1 Feb. 25, 2016

Related U.S. Application Data

(63) Continuation of application No. 13/715,530, filed on Dec. 14, 2012, now Pat. No. 8,998,783.

(51) Int. Cl.

| | |
|---|---|
| ***A63B 71/00*** | (2006.01) |
| ***A63B 21/00*** | (2006.01) |
| ***A63B 23/12*** | (2006.01) |
| *A63B 71/06* | (2006.01) |

(52) U.S. Cl.

CPC .... *A63B 21/00047* (2013.01); *A63B 21/4037* (2015.10); *A63B 23/1236* (2013.01); *A63B 23/1281* (2013.01); *A63B 2071/0625* (2013.01); *A63B 2220/17* (2013.01)

(58) Field of Classification Search

CPC ..... A63B 21/00; A63B 21/00047; A63B 21/00181; A63B 21/00189; A63B 21/02; A63B 21/021–21/028; A63B 21/40; A63B 21/4007; A63B 21/05; A63B 23/1281; A63B 23/1227; A63B 26/00; A63B 23/12; A63B 23/1209; A63B 23/1236

USPC ..... 482/92, 121, 126, 128, 141, 142

See application file for complete search history.

(56) References Cited

U.S. PATENT DOCUMENTS

| | | | | |
|---|---|---|---|---|
| 2,494,094 | A * | 1/1950 | Horstman | A63B 23/0211 482/128 |
| 2,666,640 | A * | 1/1954 | Jennings, Sr. | A63B 3/00 482/141 |
| D251,288 | S | 3/1979 | Myers | |
| 4,826,151 | A * | 5/1989 | Nuredin | A63B 21/0004 297/423.38 |
| 4,900,015 | A * | 2/1990 | Dissinger | A63B 21/4035 482/121 |

(Continued)

OTHER PUBLICATIONS

Amazon.com: Perfect Pushup Counter: Sports & Outdoors, http://www.amazon.com/Perfect-Pushup-PA6301-Counter/dp/B001LO0F98S, 5 pages (Date Printed Nov. 2, 2012).

(Continued)

*Primary Examiner* — Stephen R Crow
*Assistant Examiner* — Garrett Atkinson
(74) *Attorney, Agent, or Firm* — Merchant & Gould P.C.

(57) ABSTRACT

A push up device includes a support device including a base for positioning on the floor, side supports and a top. A control device at the top includes a push up counter, a timer, and/or an audio signaling device. The support device includes adjustable arms which adjust the relative height between the top and the base. Hand supports extend from opposite sides of the support device. In one embodiment, the hand supports are removably mounted from the support device.

18 Claims, 11 Drawing Sheets

(56) References Cited

U.S. PATENT DOCUMENTS 5,226,868 A 7/1993 Montgomery
5,242,355 A * 9/1993 Costa ..... A63B 21/00047 377/5
5,421,800 A * 6/1995 Mullen ..... A63B 21/00181 482/121
D363,442 S * 10/1995 Mullinix ..... D10/97
5,503,101 A * 4/1996 Mullinix ..... A63B 23/12 116/139
5,582,565 A * 12/1996 Soria ..... A63B 21/00047 482/141
5,632,707 A 5/1997 Daniel et al.
5,643,162 A * 7/1997 Landers ..... A63B 21/154 482/131
5,890,997 A 4/1999 Roth
6,120,421 A * 9/2000 Kuo ..... A63B 23/1209 482/111
6,129,651 A * 10/2000 Denaro ..... A63B 21/00047 482/141
6,229,764 B1 * 5/2001 Tongue ..... A63B 69/0028 340/323 R
D467,632 S 12/2002 Berns
6,543,247 B2 4/2003 Strauss
6,663,547 B1 12/2003 Hughes
6,976,943 B1 12/2005 Hsiung
7,052,449 B2 * 5/2006 Chen ..... A63B 21/0004 482/142
7,318,793 B2 * 1/2008 Dubrul ..... A63B 21/00181 482/141
7,377,888 B2 5/2008 Godbold
7,468,025 B2 12/2008 Hauser et al.
D587,612 S 3/2009 Mills et al.
7,553,267 B1 6/2009 Hauser et al.
D597,153 S 7/2009 Friedman et al.
D599,417 S 9/2009 Friedman et al.
7,604,582 B2 10/2009 Abdallah
7,618,358 B2 * 11/2009 Traub ..... A63B 26/003 482/147
7,645,221 B1 * 1/2010 Curry ..... A63B 21/023 482/142
7,803,096 B2 * 9/2010 Mehta ..... A63B 22/14 482/112
8,088,052 B1 * 1/2012 Sprague ..... A63B 21/0004 482/131
D662,997 S 7/2012 Su
8,998,783 B2 4/2015 Orenstein
2004/0102296 A1 * 5/2004 Dubrul ..... A63B 21/00181 482/141
2005/0009677 A1 * 1/2005 Yang ..... A63B 5/11 482/142
2005/0020418 A1 * 1/2005 Lin ..... A63B 21/0552 482/142
2005/0227836 A1 * 10/2005 Wen ..... A63B 21/068 482/141
2005/0245371 A1 * 11/2005 Chen ..... A63B 23/12 482/141
2005/0250628 A1 * 11/2005 Goldstein ..... A63B 23/1209 482/141
2006/0035771 A1 2/2006 Gant
2006/0040808 A1 * 2/2006 Riazi ..... A63B 21/00047 482/141
2007/0129226 A1 * 6/2007 Leavitt ..... A63B 23/0458 482/129
2007/0298947 A1 * 12/2007 Eksteen ..... A63B 21/0004 482/141
2009/0186750 A1 7/2009 Hauser et al.
2009/0186751 A1 7/2009 Hauser et al.
2010/0113225 A1 * 5/2010 Mills ..... A63B 21/4019 482/8
2011/0160026 A1 * 6/2011 Perez, Jr. ..... A47C 3/0252 482/142
2011/0275499 A1 * 11/2011 Eschenbach ..... A63B 21/00181 482/141
2013/0123081 A1 * 5/2013 Boland ..... A63B 21/4023 482/141

OTHER PUBLICATIONS

AssessPro® Rep-Addition™ Push-Up Tester, http://www.gophersport.com/products/item_detail.cfm?item_id=9447, 1 page (Copyright 2012).
Gopher Sport Catalog 2012 including note on last page reading "Postmaster: Please deliver by Dec. 17, 2011" (4 pages).
Konami's push-up counter keeps you motivated, http://www.engadget.com/2007/10/13/konamis-push-up-counter-keeps-you-motivated, 1 page (Oct. 13, 2007).
Perfect Pushup Counter Makes Workouts More Effective, http://inventorspot.com/articles/perfect_pushup_counter_makes_workouts_more_effectiv . . . , 3 pages (Date Printed Nov. 2, 2012).
Photographs of a Perfect Pushup commercial product for the "Perfect Counter", including photographs of the product, the packaging, and the product literature, 15 pages (2008).
Pushup Counter Will Help Your Keep Track of Your Pushups, http://www.ubergizmo.com/2010/02/pushup-counter-will-help-your-keep-track-of-your-p . . . , 3 pages (Feb. 10, 2010).
Restriction Requirement for U.S. Appl. No. 29/439,802, dated Jan. 28, 2014, 5 pages.
Design U.S. Appl. No. 29/439,802, filed Dec. 14, 2012 entitled Push Up Device.

* cited by examiner

PUSH UP DEVICE

CROSS REFERENCE TO RELATED APPLICATION

This application claims the priority to U.S. application Ser. No. 13/715,530, filed Dec. 14, 2012, now U.S. Pat. No. 8,998,783 and titled "Push Up Device," the disclosure of which is hereby incorporated herein by reference.

FIELD OF THE INVENTION

The present invention relates to a push up device for use for exercise or therapeutic activates involving push ups.

BACKGROUND

Push ups are commonly done exercises for children and adults. Push ups can be done without any equipment if desired. Equipment has been developed for promoting proper technique and/or for promoting counting for recordation or tracking purposes. Continued improvements in this area are desired.

SUMMARY

One aspect of the present invention includes a push up device including a support device which includes a base for resting on a floor surface and an upright portion which holds a user engagement device at a spaced apart distance from the floor. The user engagement device can include a control device which may include a user contacting element and one or more of the following: a timer, a counter, and/or an audible signaling device. The contacting element registers when a push up has been completed.

The support device may be adjustable in height to accommodate users who desire that the contacting element be positioned at a different height relative to the floor.

The push up device may include hand supports connected to the support device which holds the user engagement device.

In one embodiment, the hand supports are separately mounted to the support device.

In one embodiment, the support device includes two opposite sidewalls made from flexible materials which promote collapsing of the top downwardly in the event the user falls or uncontrollably contacts the support device to prevent breakage of the device and/or injury to the user.

DETAILED DESCRIPTION OF THE PREFERRED EMBODIMENT

Figure 1:
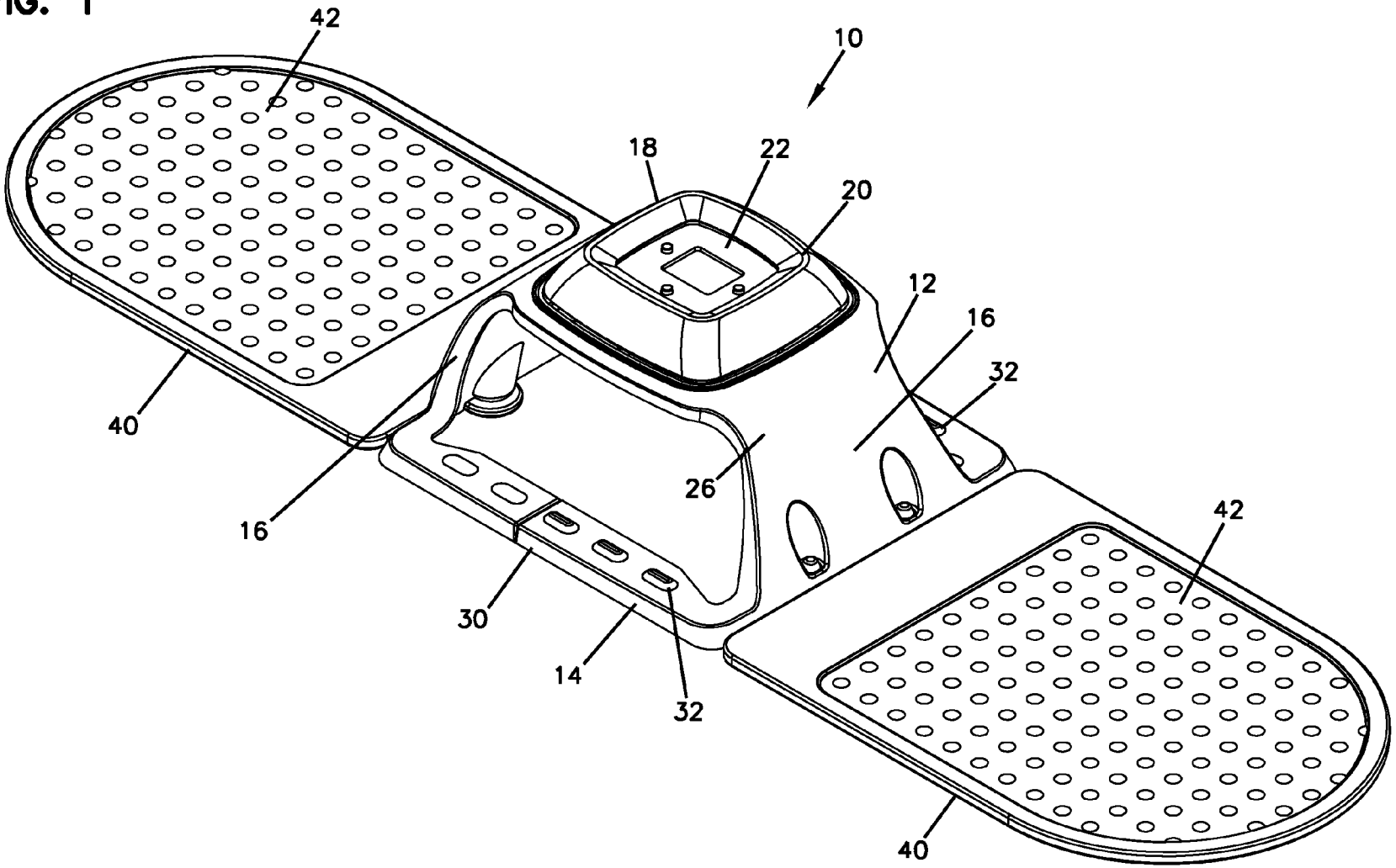
FIG. 1 is a perspective view of a push up device in accordance with the present invention.
Figure 2:
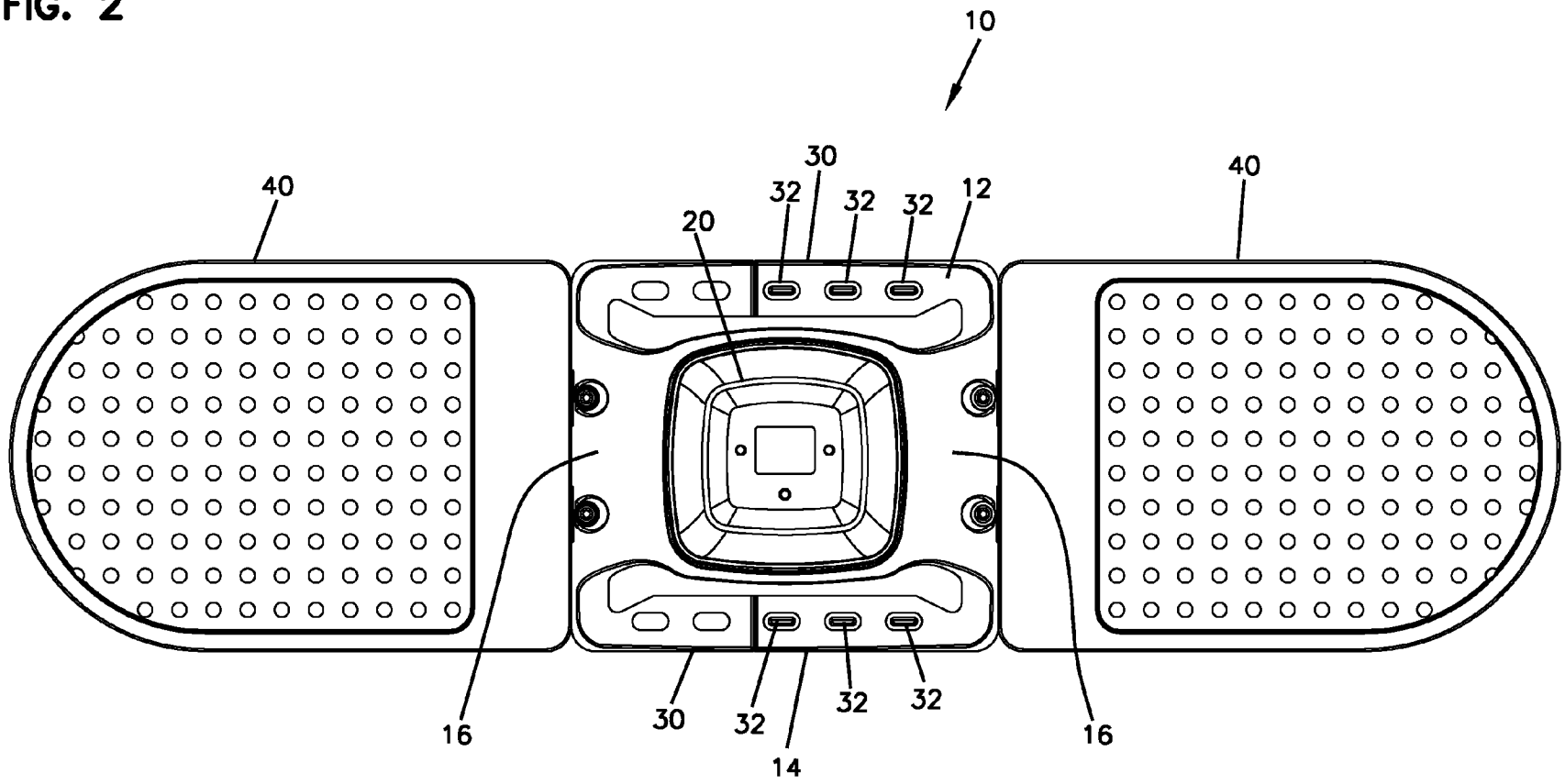
FIG. 2 is a top view of the push up device of FIG. 1.
Figure 3:
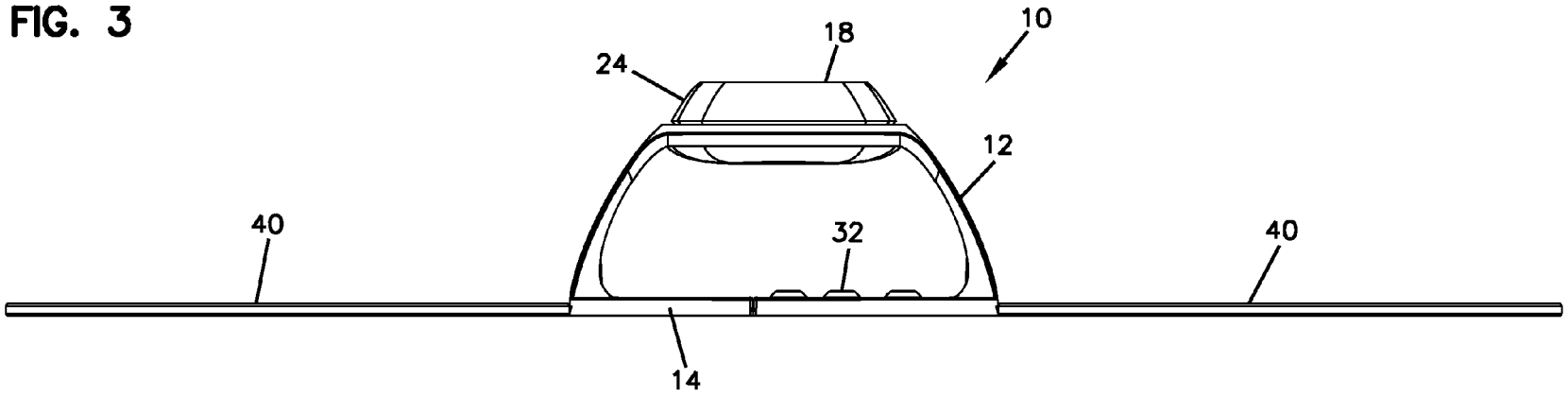
FIG. 3 is a first side view of the push up device of FIG. 1.
Figure 4:
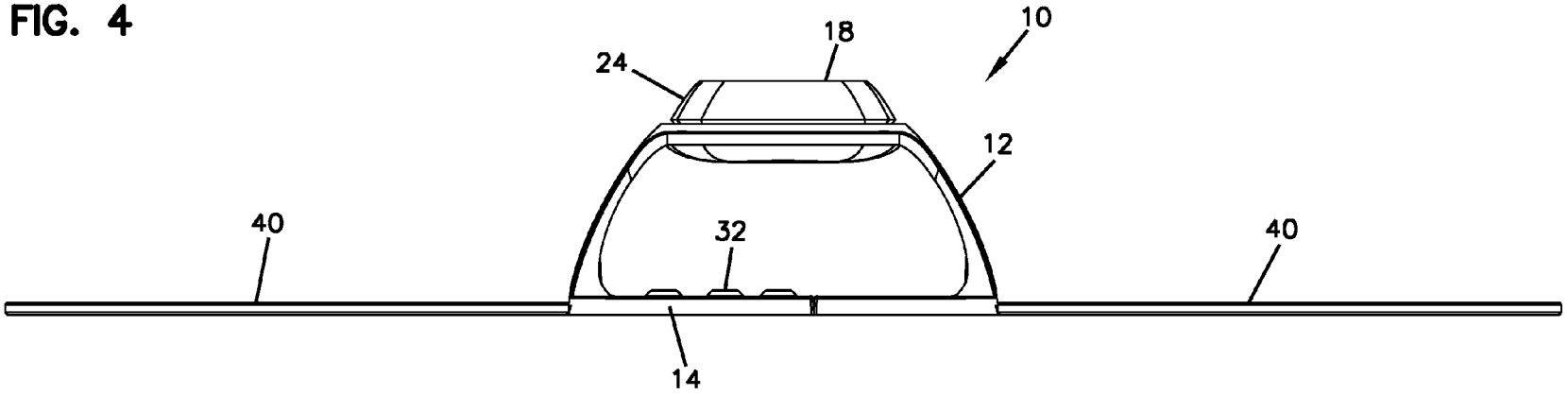
FIG. 4 is a further side view of the push up device of FIG. 1, opposite to the side view of FIG. 3.
Figure 5:
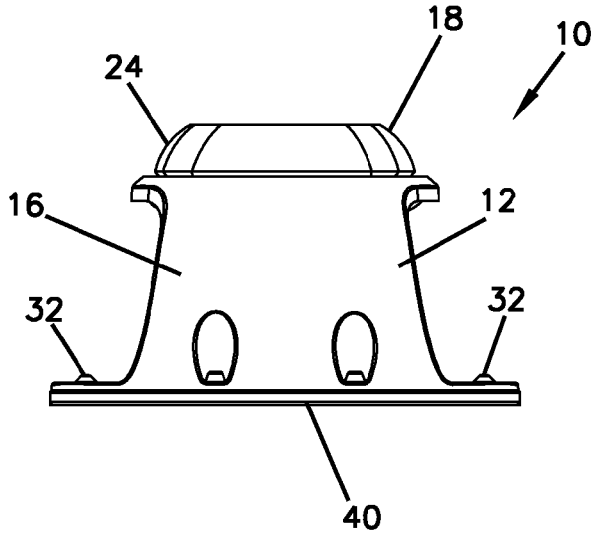
FIG. 5 is another side view of the push up device of FIG. 1.
Figure 6:
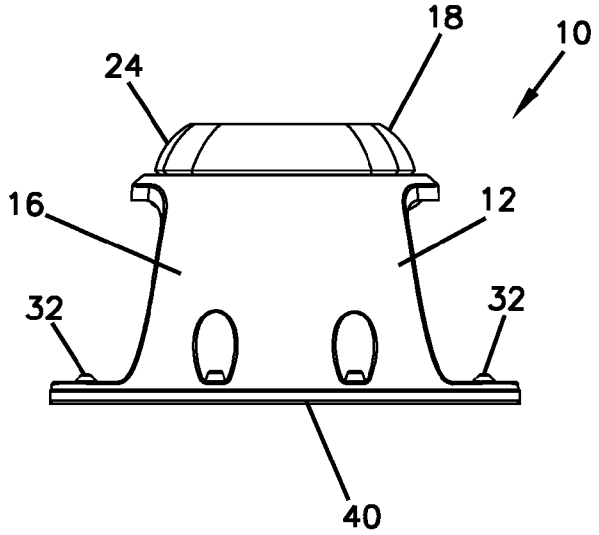
FIG. 6 is a further side view of the push up device of FIG. 1, opposite to the side view of FIG. 5.
Figure 7:
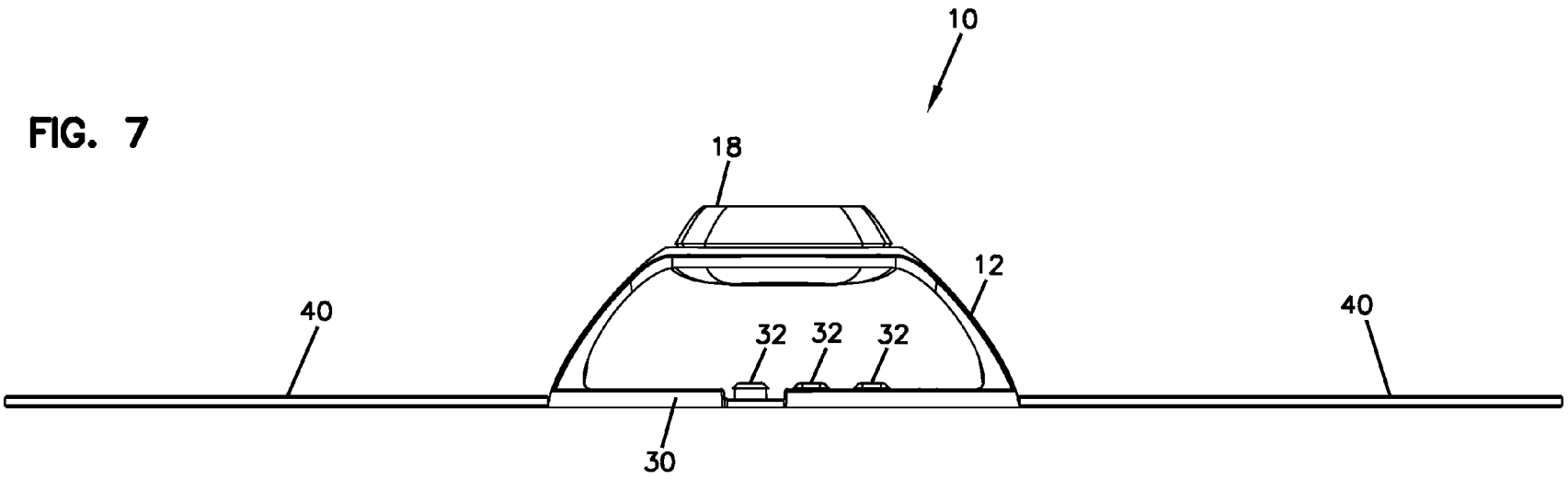
FIGS. 7 and 8 show the adjustability of the support device of FIG. 1 in a first lower position for the user contacting element.
Figure 8:
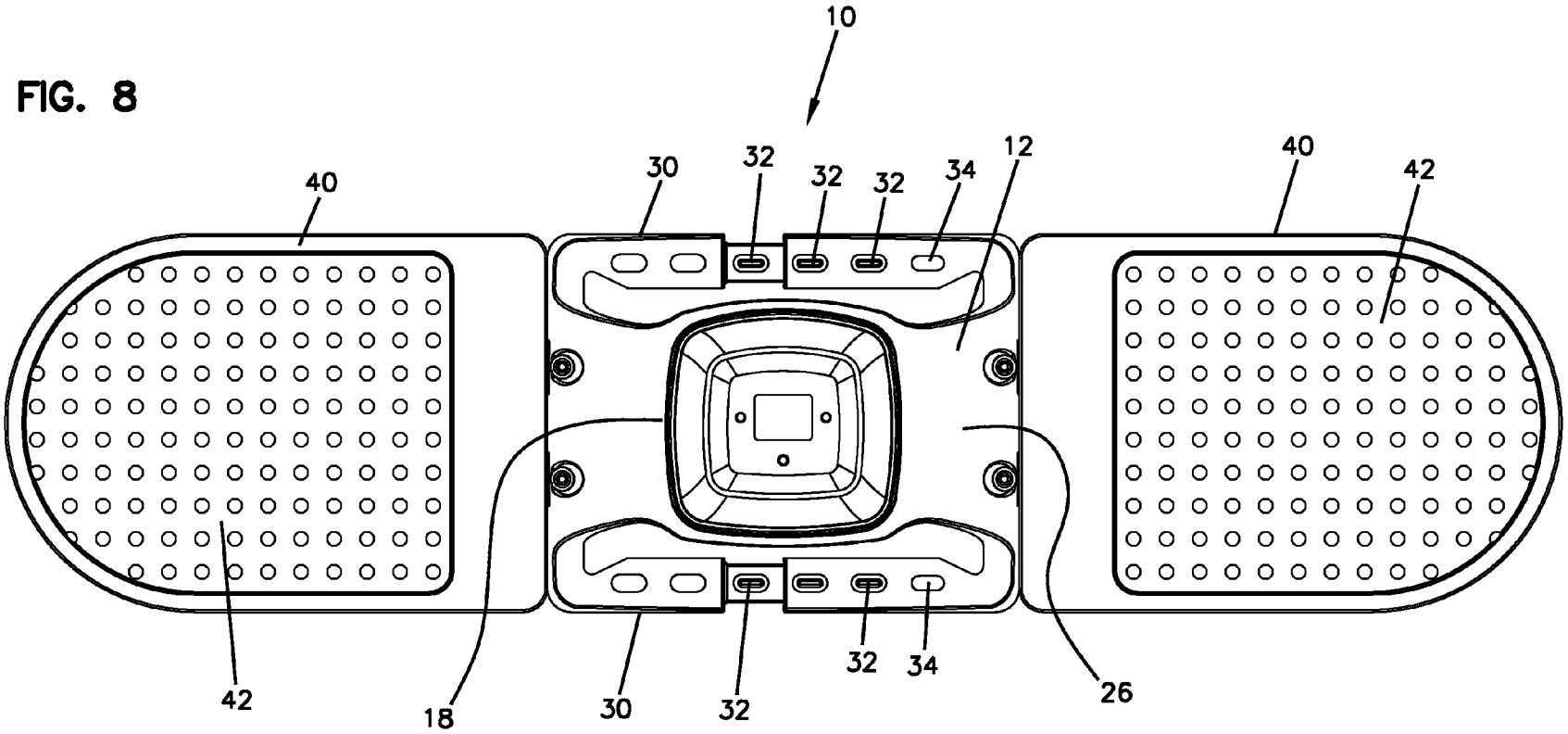
Figure 9:
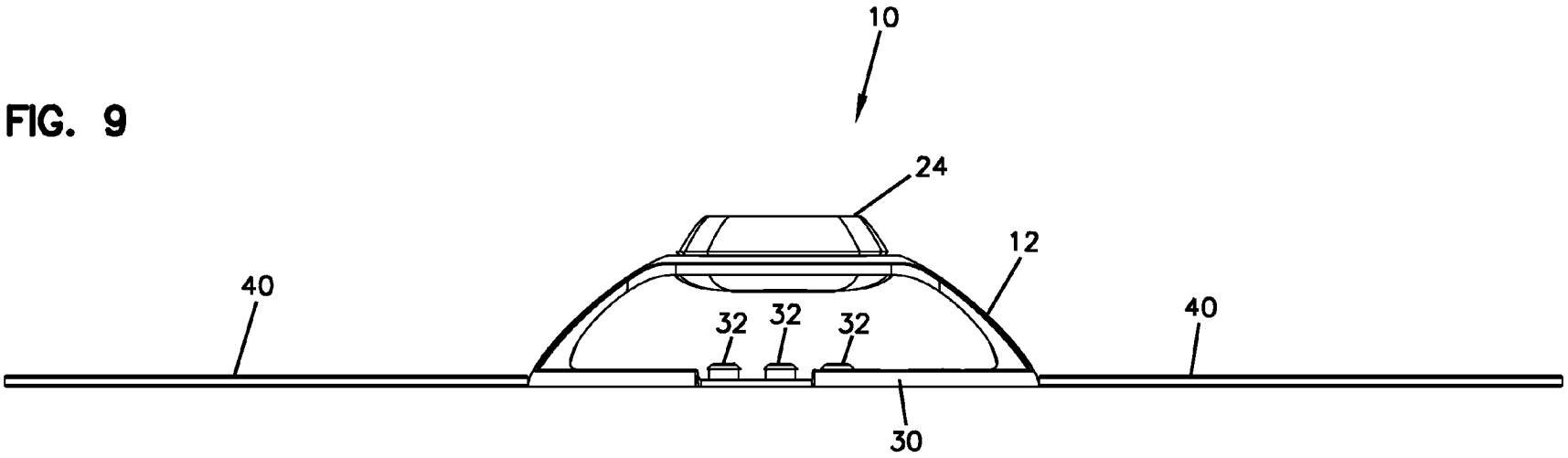
FIGS. 9 and 10 show the adjustability of the support device of FIG. 1 in a second lower position for the user contacting element.
Figure 10:
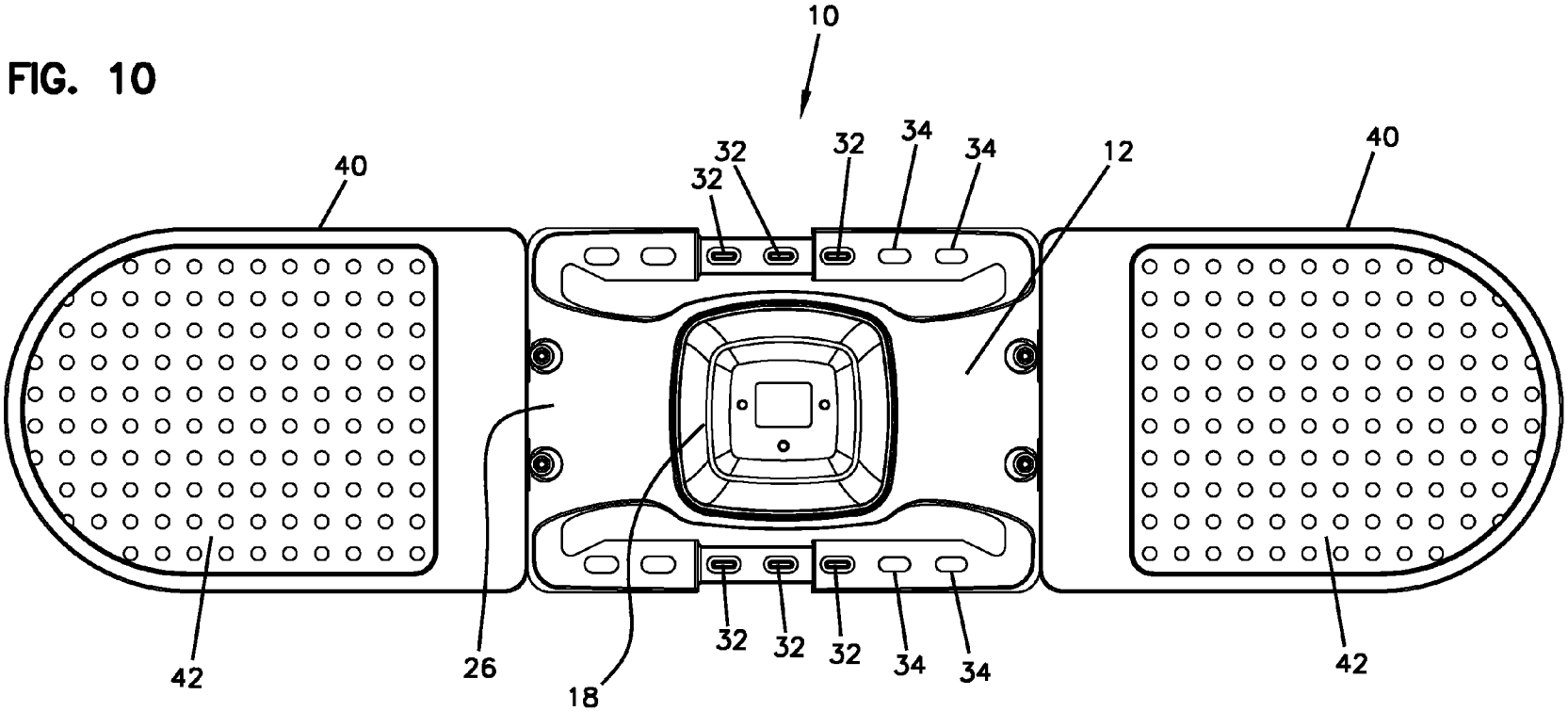
Figure 11:
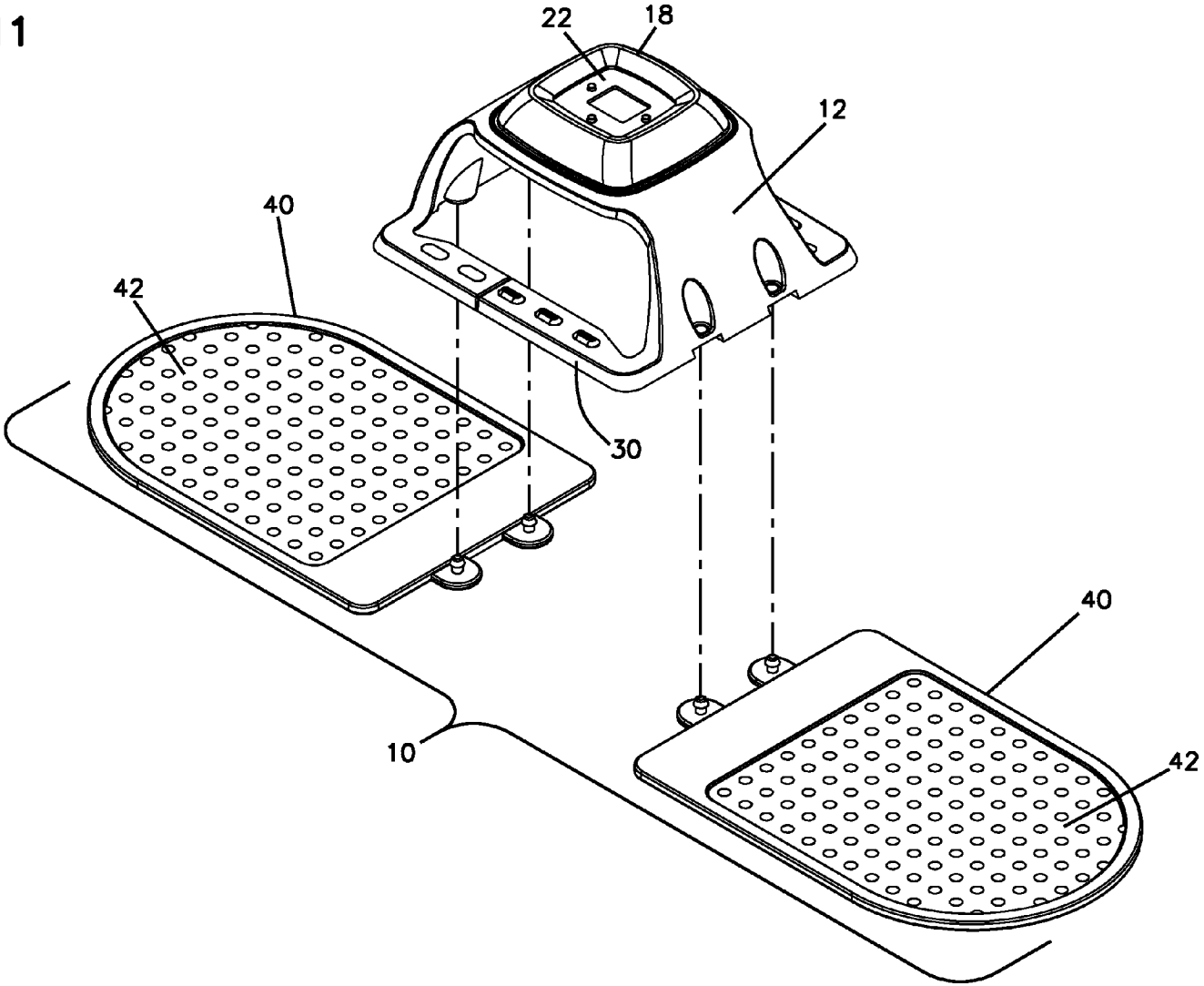
FIG. 11 shows the separate hand supports of the push up device.
Figure 12:
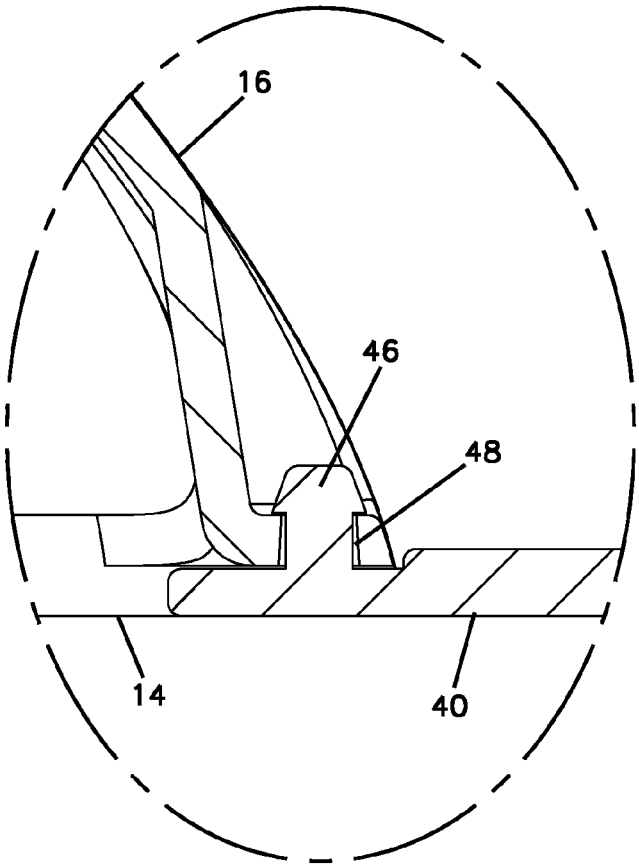
FIG. 12 shows in cross-section one of the mounting arrangements between a hand support and the support device.
Figure 13:
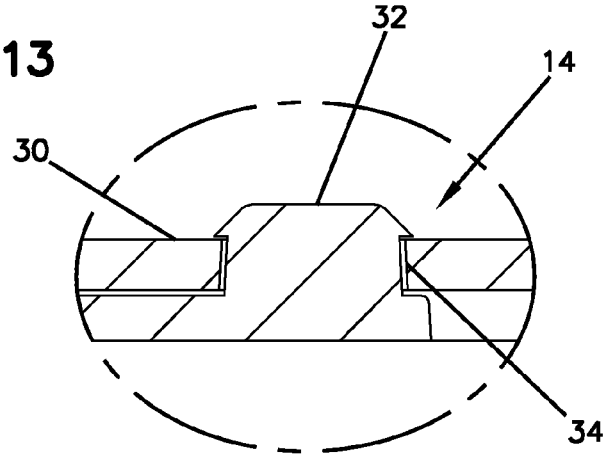
FIG. 13 shows in cross-section one of the mounting arrangements of the support device for adjusting the height.
Figure 14:
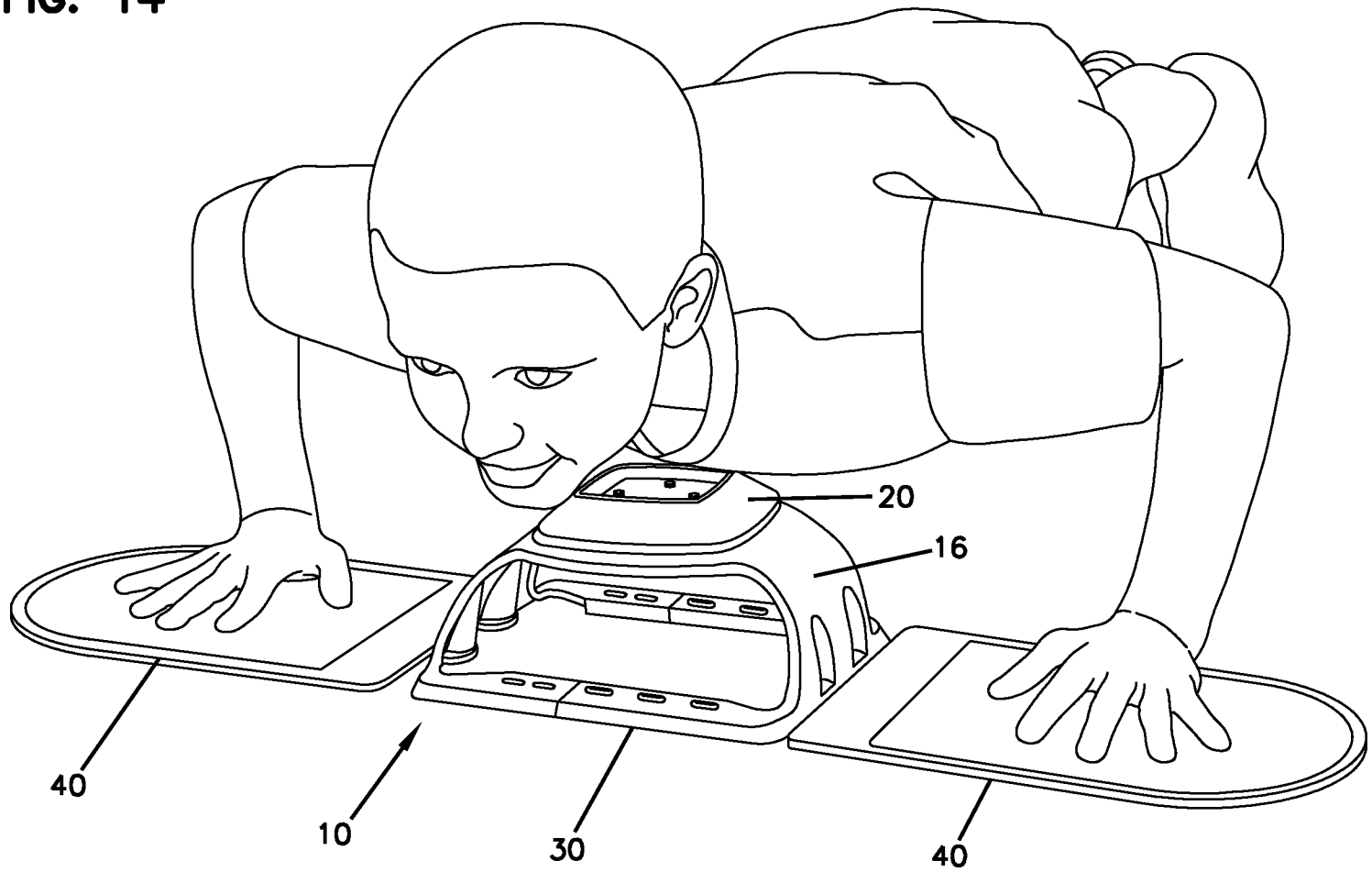
FIG. 14 shows the push up device of FIGS. 1-13 during use by a user doing a push up.

A push up device 10 is shown in FIGS. 1-13. The push up device includes a support device 12 with a base 14 for positioning on a floor surface. Extending upward from base 14 is an upright portion in the form of two side supports 16 which extend to a top 20. Top 20 includes a control device 22. Control device 22 can include one or more of the following features and functions: a counter, a timer, an audio signaling device. Control device 22 includes a user engagement device or portion 18 which the user contacts to register the completion of a push up.

Control device 22 includes a pressure sensitive top element 24 which is contacted by the user when the user moves downwardly to do a push up exercise. One example may include a spring biased portion and a sensor that senses contact when the spring bias is overcome during movement. Upon contacting top element 24, a sensor within control device 22 registers the completion of a push up. The control device 22 can count push ups upwardly from a desired number such as zero (0), downwardly from a desired number such as 10, 25, 100, or other, or relative to a timer. An audio signal can be combined with the counting and the timing functions, or used separately.

Support device 12 includes a body construction 26 from flexible material such that if the user falls onto support device 12 or collapses onto support device 12 during exercise, support device 12 is not broken, and/or does not injure the user. For example, side supports 16 can each collapse toward one side or the other which causes a corresponding lowering of control device 22 toward the floor.

Support device 12 is adjustable such that control device 22 can be positioned at different heights relative to the floor. The length of base 14 can be changed. Due to the flexible construction of body construction 26, changing the length of base 14 causes a corresponding change in the height of top 20. Compare FIGS. 3 and 4 with FIGS. 7 and 9. Base 14 includes arms 30 which are adjustable in length. Compare FIGS. 2-4 with FIGS. 7 and 8, and FIGS. 9 and 10. Locking tabs 32 fit into mating locking slots 34 to hold arms 30 in the desired length. Locking tabs 32 and locking slots 34 releaseably snap together.

Push up device 10 includes hand supports 40 on opposite sides of support device 12. Hand supports 40 provide a location 42 for a user to place their hands during the push up exercise. Hand supports 40 promote proper positioning of support device 12 so as to contact the user adjacent the user's chest. Hand supports 40 also keep the user from contacting the floor which may be dusty, or not clean. Further, hand supports 40 promote a non-slip engagement by the user with push up device 10. Hand supports 40 can be shaped and textured as desired to promote desired gripping and non-slip properties.

In one embodiment, hand supports 40 are separate from support device 12, and are attachable to form a single unit. One method of attachment of hand supports 40 to support device 12 is with locking tabs 46 and mating locking slots 48. Locking tabs 46 and locking slots 48 releaseably snap together.

In one embodiment, a plurality of push up devices 10 can be stacked on top of one another in a compact manner wherein the support devices 12 nest within one another with the top 20 of a lower push up device 10 fitting within support device 12 of an upper device 10.

What is claimed is:

1. A push up device comprising:

a support device including a base, a first side support which extends upwardly from the base to a top, a second side support opposite the first side support which extends upwardly from the base to the top, the top and the first and second side supports forming an arch, wherein each side support is made from a flexible material configured to collapse the top of the support device toward the base in the event the user falls onto the support device or collapses during a push up, the base being configured to seat on a surface;

a control device positioned at the top for engagement by the user during a push exercise, the control device including a push up counter;

a first hand support extending from a first side of the support device, the first hand support having a first major side and an opposite second major side connected by an edge, the first hand support being oriented so that a majority of the first major side faces and seats on the surface and the second major side faces away from the surface and defines a location for a user to place a hand of the user.

2. The push up device of claim 1, further comprising a second hand support extending from a second side of the support device, the second side being opposite the first side.

3. The push up device of claim 2, wherein the second hand support has a first major side and an opposite second major side, the second hand support being oriented so that the first major side of the second hand support faces and seats on the surface and the second major side of the second hand support faces away from the surface.

4. The push up device of claim 3, wherein the first and second sides of each hand support extend from a first end to a second end of the respective hand support, and wherein the first end of each hand support couples to the support device.

5. The push up device of claim 4, wherein the second end of each hand support is curved.

6. The push up device of claim 2, wherein both hand supports are removably mounted to the support device.

7. The push up device of claim 6, wherein the hand supports are removably mounted to the support device with a locking tab and slot arrangement.

8. The push up device of claim 2, wherein each hand support is configured to provide a non-slip engagement by the user with the push up device.

9. The push up device of claim 8, wherein the second surface of each hand support is textured.

10. The push up device of claim 2, wherein a length of the first hand support is equal to a length of the second hand support.

11. The push up device of claim 1, wherein the first hand support is removably mounted to the support device.

12. The push up device of claim 11, wherein the first hand support is removably mounted to the support device with a locking tab and slot arrangement.

13. The push up device of claim 1, wherein the first hand support is configured to provide a non-slip engagement by the user with the push up device.

14. The push up device of claim 13, wherein the second surface of the first hand support is textured.

15. The push up device of claim 1, wherein the first and second sides of the first hand support extend from a first end to a second end of the first hand support, and wherein the first end of the first hand support couples to the support device.

16. The push up device of claim 15, wherein the second end of the first hand support is curved.

17. The push up device of claim 1, wherein a length of the first hand support is greater than a length of the support device.

18. A push up device comprising:

a support device including a base and a side support which extends upwardly from the base to a top, the base being configured to seat on a surface, the side support being made from a flexible material configured to collapse the top of the support device toward the base in the event the user falls onto the support device or collapses during a push up;

a control device positioned at the top for engagement by the user during a push exercise, the control device including a push up counter;

a first hand support extending from a first side of the support device, the first hand support having a first major side and an opposite second major side connected by an edge extending fully along a periphery of the first and second major sides, the first hand support being oriented so that the first major side faces and seats on the surface and the second major side faces away from the surface and defines a location for a user to place a hand of the user; and a second hand support extending from a second side of the support device parallel with the first hand support, the second side being opposite the first side, the second hand support has a first major side and an opposite second major side connected by an edge extending fully along a periphery of the first and second major sides, the second hand support being oriented so that the first major side of the second hand support faces and seats on the surface and the second major side of the second hand support faces away from the surface.

* * * * *